US006991565B1

(12) United States Patent
Kasashima

(10) Patent No.: US 6,991,565 B1
(45) Date of Patent: Jan. 31, 2006

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/988,842

(22) Filed: Nov. 16, 2004

(51) Int. Cl.
*A63B 37/12* (2006.01)

(52) U.S. Cl. ..... 473/384

(58) Field of Classification Search ..... 473/378–385
See application file for complete search history.

(56) References Cited

U.S. PATENT DOCUMENTS 6,450,902 B1 * 9/2002 Hwang ..... 473/383

* cited by examiner

*Primary Examiner*—Raeann Gorden
(74) *Attorney, Agent, or Firm*—Sughrue Mion, PLLC

(57) ABSTRACT

Disclosed herein is a golf ball having a plurality of round dimples on the surface thereof, which is characterized in that said dimples include those of two kinds or more differing in diameter such that the ratio of the maximum diameter to the minimum diameter is at least 1.5, said dimples add up to 240 to 290, with large dimples 4.7 mm or above in diameter accounting for more than 50%, and said dimples are formed such that the volume under a flat surface surrounded by the edge of each dimple divided by the volume of a hypothetical cylinder having said flat surface as the bottom and the maximum depth from the bottom as the height is 0.49 to 0.85 on average for all the dimples. The golf ball having adequately formed and arranged dimples achieves a long flying distance.

6 Claims, 3 Drawing Sheets

GOLF BALL

BACKGROUND OF THE INVENTION

The present invention relates to a golf ball excellent in flight performance.

For improvement of conventional solid golf balls in striking feel and controllability (ability to stop soon on the green), attempts have been made to optimize the physical properties (such as hardness) of their core and cover so that they exhibit their best performance with a relatively high rate of spin (or when they are hit by a driver such that they receive a back spin of about 3000 rpm).

However, it has recently been known that a golf ball achieves a long flying distance when it is hit with a low spin and a high launch angle. Therefore, nowadays, hitting with a backspin as low as 2000 rpm is not rare owing to the recent development of balls and clubs (particularly drivers for a long shot).

Under such low-spin conditions, the hit ball has a low coefficient of drag, which contributes to flying distance. However, with a low spin, a golf ball with conventional dimples decreases in lift after it has reached the maximum height of the trajectory and begun to decrease in velocity. The decreased lift causes the golf ball to drop rapidly, thereby decreasing its flying distance.

SUMMARY OF THE INVENTION

The present invention was completed in view of the foregoing. It is an object of the present invention to provide a new golf ball having adequately formed and arranged dimples to keep lift even in the low-spin region of trajectory, thereby attaining a long flying distance.

In order to achieve the above-mentioned object, the present inventors carried out a series of researches, which led to the finding that a golf ball exhibits an improved flight performance if it has round dimples which are formed and arranged in a specific way. The present invention is based on this finding. The golf ball according to the present invention is characterized by its dimples formed on its surface. It has more than one kind of round dimples differing in diameter, with large dimples dominating and arranged densely. These dimples have a large volume relative to their diameter and are preferably relatively shallow.

The present invention is directed to a golf ball as defined in the following.

[1] A golf ball having a plurality of round dimples on the surface thereof, which is characterized in that said dimples include those of two kinds or more differing in diameter such that the ratio of the maximum diameter to the minimum diameter is at least 1.5, said dimples add up to 240 to 290, with large dimples 4.7 mm or above in diameter accounting for more than 50%, and said dimples are formed such that the volume under a flat surface surrounded by the edge of each dimple divided by the volume of a hypothetical cylinder having said flat surface as the bottom and the maximum depth from the bottom as the height is 0.49 to 0.85 on average for all the dimples.

[2] The golf ball of [1] above, wherein the dimples account for 79% to 89% of the entire surface area of the golf ball, and the dimples are arranged such that there exist no or only one great circle not intersecting the dimples on the surface of the golf ball.

[3] The golf ball of [1] above, which include those dimples formed such that the dimple's central region within half the radius from the dimple's center has a cross section coinciding with the radius of curvature larger than 20 mm, with its center placed outside in the radial direction of the golf ball.

[4] The golf ball of [1] above, wherein the dimples have a cross section such that the straight line connecting both edges of the cross section and the side wall leading to the edge of the cross section make an angle of 10° to 25°.

[5] The golf ball of [1] above, wherein the dimples are formed such that the ratio VR of the total volume of dimples under flat surface surrounded by the edges of dimples is 0.6% to 1.1% to the volume of the ball which is calculated assuming that there are no dimples.

[6] The golf ball of [1] above, which has aerodynamic properties such that the coefficient of lift (CL) of the hit ball with a Reynolds number of 70000 and a spin of 2000 rpm is higher than 70% of that of the hit ball with a Reynolds number of 80000 and a spin of 2000 rpm, and the coefficient of drag (CD) of the hit ball with a Reynolds number of 180000 and a spin of 2520 rpm is lower than 0.225.

DETAILED DESCRIPTION OF THE INVENTION

The invention will be described below in more detail with reference to the accompanying drawings.

Figure 1:
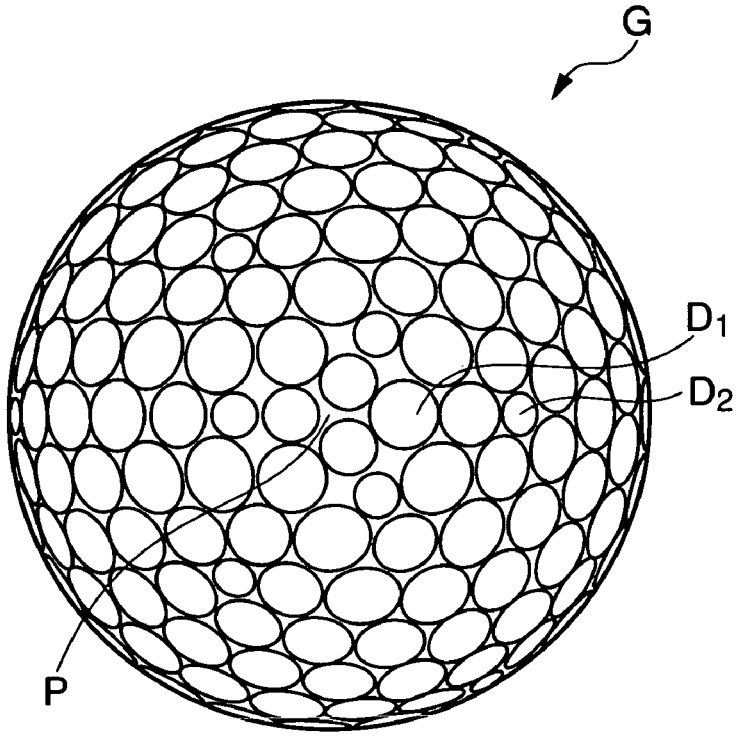
FIG. 1 is a plan view of the golf ball pertaining to the first example of the present invention.
Figure 2:
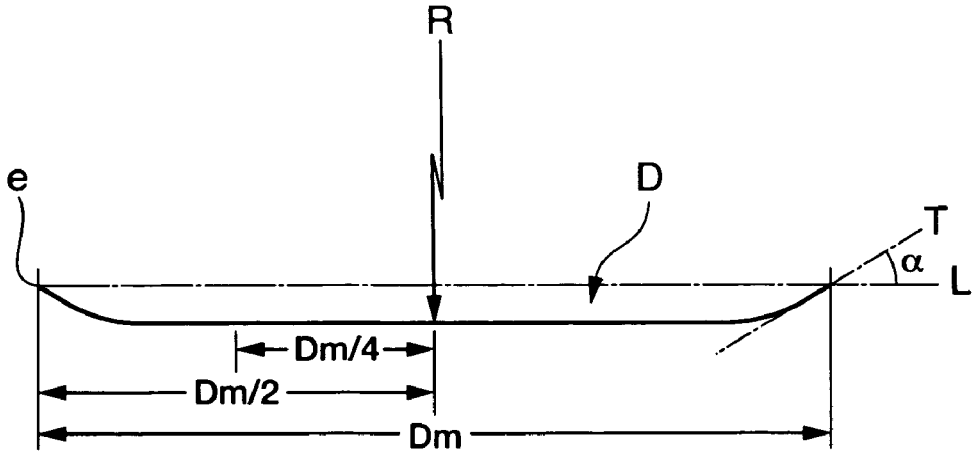
FIG. 2 is an enlarged sectional view of one of the dimples shown in FIG. 1.
Figure 3:
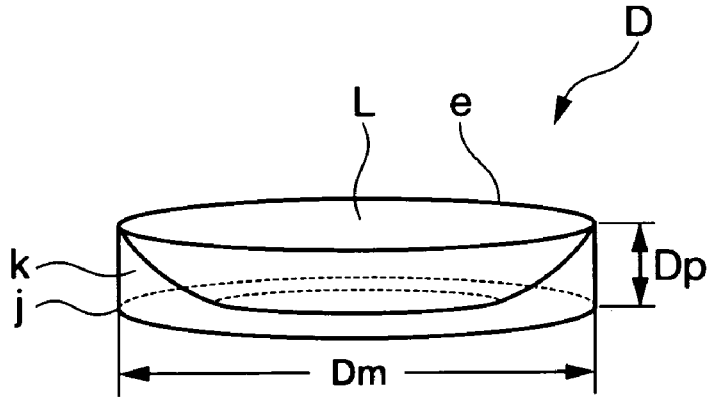
FIG. 3 is a diagram illustrating the volume (Vo) of one dimple.

FIG. 1 is a plan view of the golf ball pertaining to the first example of the present invention, and FIG. 2 is an enlarged sectional view of one of the dimples formed in the golf ball shown in FIG. 1. The golf ball according to the present invention has a large number of round dimples on its surface. These dimples differ in diameter; in fact, there are 3 to 20 kinds of dimples. The ratio of the maximum diameter (dimple $D_1$) to the minimum diameter ($D_2$) is 1.5 or above. The dimples add up to 240 to 290, preferably 250 to 280. Large dimples with a diameter of 4.7 mm and up account for more than 50%. These dimples are formed such that the volume under a flat surface surrounded by the edge of each dimple divided by the volume of a hypothetical cylinder having said flat surface as the bottom and the maximum depth from the bottom as the height is 0.49 to 0.85 on average for all the dimples. The value of this ratio is referred to as Vo hereinafter.

According to the present invention, the ratio of the maximum diameter of dimples to the minimum diameter of dimples should be no lower than 1.5 and no higher than 3.0. With a ratio lower than 1.5, the dimples will not cover the surface area of the golf ball in a desirably high ratio. With a ratio higher than 3.0, the dimples with the minimum diameter are too small to produce their effect.

According to the present invention, large dimples having a diameter of 4.7 mm or above should account for 50% or above, preferably 60 to 96%. A golf ball with this ratio lower than 50% will not exhibit the improved fight performance intended in the present invention. A golf ball with this ratio higher than 96% will not have densely arranged dimples, with a large part of the ball's surface remaining flat (or land).

The value of Vo defined above should be no lower than 0.49, preferably no lower than 0.52, more preferably no lower than 0.6, and no higher than 0.85, preferably no higher than 0.80, more preferably no higher than 0.75. If the value of Vo is lower than 0.49 or higher than 0.85, the golf ball will not have desirable aerodynamic properties and hence will not fly as expected. The value of Vo is calculated as follows. The first step is to obtain the volume surrounded by the concave surface of the dimple and a hypothetical circular flat surface L (having a diameter of Dm) demarcated by the edge of the dimple. The second step is to obtain the volume of a hypothetical cylinder defined by the bottom j, which equals the circular flat surface L, and the height, which is the maximum depth (Dp) of the dimple measured from the circular flat surface L. The ratio of the volume of the dimple to the volume of the cylinder is the value of Vo.

According to the present invention, the ratio of the total area of the dimples to the entire surface area of the golf ball should be 79% to 89%. To be more specific, this ratio is obtained by dividing the sum of flat areas each surrounded by the edge of the dimple by the surface area of the ball which is calculated assuming that the ball has no dimples. The dimples should be arranged such that there exist no or only one great circle not intersecting them on the surface of the golf ball.

The golf ball according to the present invention should have dimples formed such that the dimple's central region within half the radius Dm/2 (which equals one-forth the diameter Dm) from the dimple's center has a cross section as a bottom portion coinciding with the radius of curvature R equal to or larger than 20 mm, with its center placed outside in the radial direction of the golf ball. This is illustrated in FIG. 2 which is a sectional view of one dimple. The radius of curvature R may be infinity, which implies that the dimple may have a flat bottom. Moreover, the dimple may even have a bulged bottom so long as it does not hamper the object of the present invention. On the other hand, the side wall of the dimple may assume a curved shape (convex inward), as shown in FIG. 2. In this case, the angle $\alpha$ should preferably be 10° to 25° which is held between the tangent line T at the edge of the side wall and the flat surface L connecting the edges e of the dimple D. Incidentally, the shape of the side wall of the dimple is not limited to a curved one as mentioned above but it may be straight from the edge to the bottom. (In this case, the dimple assumes a shape of truncated cone.)

The golf ball according to the present invention has the dimples formed such that the total volume of dimples under flat surface surrounded by the edges of dimples account for 0.6% (preferably 0.7%) to 1.1% (preferably 0.85%) of the volume of the ball which is calculated assuming that there are no dimples. In this case, the depth of the dimple should be no less than 0.05 mm, preferably no less than 0.08 mm, and no more than 0.15 mm, preferably no more than 0.13 mm.

The golf ball according to the present invention receives aerodynamic actions during its flight as follows.

If a golf ball is to achieve a long flying distance (particularly under windy conditions) and a long run when hit by a wood club #1 (driver) deigned for a long shot, it should produce well-balanced lift and drag, which depend on structure, materials, and dimples. The effect of dimples varies depending on their type, total number, total volume, and surface area occupancy.

Figure 4:
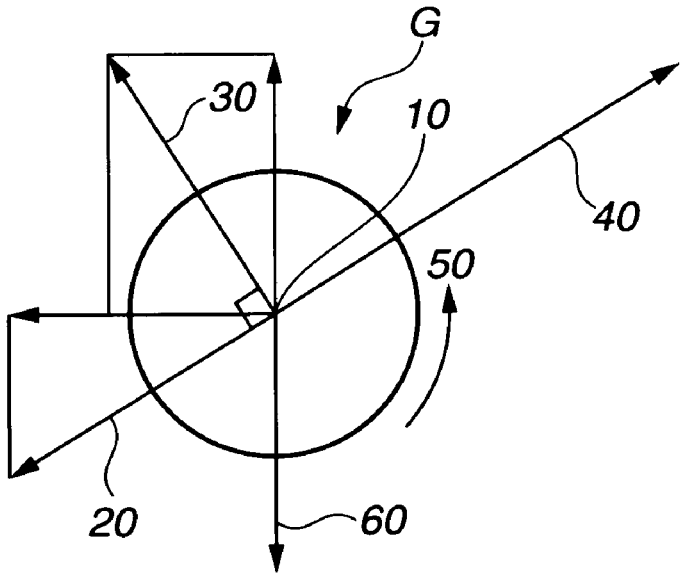
FIG. 4 is a diagram illustrating the relation between the lift and drag of a golf ball in flight.

It is known that a golf ball in flight receives gravity 60, resistance (drag) 20 by air, and lift 30 due to Magnus effect produced by the ball's spin, as shown in FIG. 4. Incidentally, it is assumed that the ball G flies in the direction 40, the ball has its center 10, and the ball spins in the direction 50.

In this case, the force acting on the golf ball is represented by the trajectory equation (1) given below.

$$F=FL+FD+Mg \tag{1}$$

where,

F: force acting on the golf ball
FL: lift
FD: drag
Mg: gravity

The lift FL and drag FD in the trajectory equation (1) above are represented by the following formulas (2) and (3), respectively.

$$FL=0.5\times CL\times\rho\times A\times V^2 \tag{2}$$

$$FD=0.5\times CD\times\rho\times A\times V^2 \tag{3}$$

where,

CL: coefficient of lift
CD: coefficient of drag
$\rho$: density of air
A: maximum sectional area of golf ball
V: velocity of golf ball relative to air Reduction of only drag or CD (coefficient of drag) is not so effective in improving a golf ball in flying distance. A golf ball with a small coefficient of drag flies high but drops rapidly due to insufficient lift after it has reached the maximum height and begun to decrease in velocity. This results in a decreased flying distance.

The golf ball according to the present invention should have a coefficient of drag (CD) equal to or smaller than 0.225 when it has a Reynolds number of 180000 and a spin of 2520 rpm immediately after hitting. Moreover, it should have a coefficient of lift (CL) as follows. The coefficient of lift (CL) at a Reynolds number of 70000 and a spin of 2000 rpm which is measured immediately before the hit ball being reached at the maximum height of the trajectory is more than 70% of the coefficient of lift (CL) measured slightly before that when the hit ball has a Reynolds number of 80000 and a spin of 2000 rpm. Incidentally, the Reynolds numbers of 180000 immediately after hitting, 80000, and 70000 correspond to the ball velocities of about 65 m/s, 30 m/s, and 27 m/s, respectively.

For the purpose of reference, Table 1 is given below to show how the ordinary golf balls have the coefficient of drag (CD) and the coefficient of lift (CL) at the certain Reynolds number (Re) and the spin (rpm).

TABLE 1

| Re/rpm | CD | CL |
|---|---|---|
| 80000/1800 | 0.220–0.270 | 0.200–0.250 |
| 80000/3000 | 0.290–0.340 | 0.275–0.325 |
| 120000/1800 | 0.200–0.250 | 0.140–0.190 |
| 120000/3000 | 0.340–0.390 | 0.350–0.400 |
| 160000/1800 | 0.190–0.240 | 0.125–0.175 |
| 160000/3000 | 0.225–0.275 | 0.190–0.240 |
| 200000/1800 | 0.190–0.240 | 0.120–0.170 |
| 200000/3000 | 0.200–0.250 | 0.150–0.200 |

The golf ball according to the first example of the present invention has dimples arranged as shown in FIG. 1. These dimples include five kinds of dimples differing in diameter, with the maximum diameter ($D_1$) being 4.85 mm and the minimum diameter ($D_2$) being 2.98 mm. Moreover, these dimples are arranged symmetrically with respect to the axis line passing through both poles (P) at intervals of 120° around the axis line. In other words, these dimples are arranged such that dimples of the same kind appear on the same latitude at intervals of 120° around the axis line. The symmetrical arrangement mentioned above permits the coexistence of more than one kind of dimples differing in diameter and depth so long as it keeps the balance.

Figure 5:
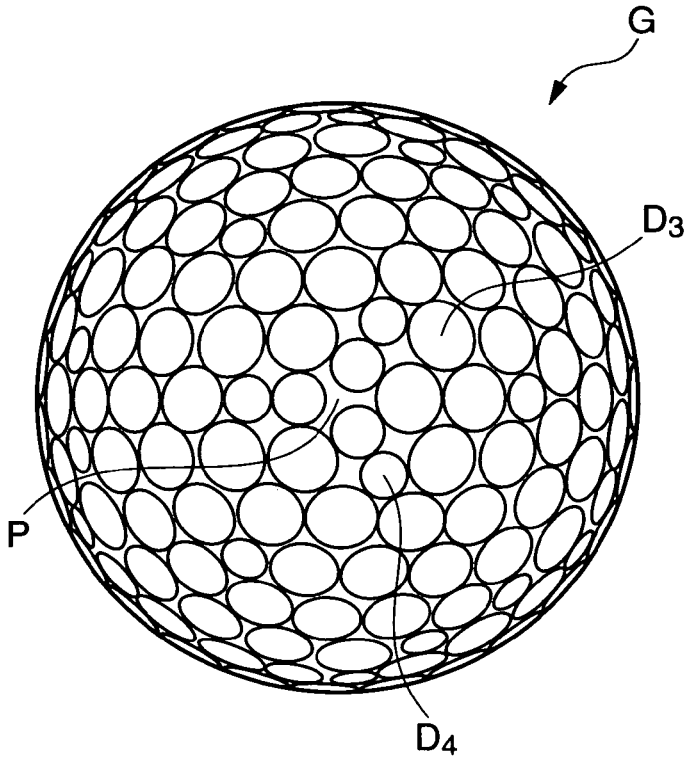
FIG. 5 is a plan view of the golf ball pertaining to the second example of the present invention.

The golf ball according to the second example of the present invention has dimples arranged as shown in FIG. 5. These dimples include six kinds of dimples differing in diameter, with the maximum diameter ($D_3$) being 5.5 mm and the minimum diameter ($D_4$) being 3.4 mm. They are arranged symmetrically with respect to the axis line passing through both poles (P) as in the first example.

The golf ball according to the present invention may be made of any material which is not specifically limited. The solid core of the golf ball should preferably be made of polybutadiene rubber. The core should have adequate rigidity such that its deflection by compression on a hard board changes about 2.0 to 5.0 mm, preferably about 2.5 to 4.5 mm, when the compressing load is increased from 10 kg to 130 kg. On the other hand, the core should have a JIS-C hardness of 30 to 70 at its center and a JIS-C hardness of 70 to 100 at its surface. To make the JIS-C hardness at its surface be harder by 10 to 30 than that at its center helps reduction of the spin of the ball hit with a high velocity. The core may be of single-layer structure or multi-layer structure.

The cover on the core may be made of polyurethane elastomer, for example. The cover should have a Shore D hardness of 35 to 75, preferably 45 to 65, and a thickness of 0.05 to 2.5 mm, preferably 0.07 to 1.5 mm.

The core and the cover may be separated from each other by an intermediate layer (or a third layer) interposed between them. The intermediate layer may be made of any of ionomer resin, polyester elastomer, etc. The intermediate layer should have a Shore D hardness of 35 to 75, preferably 45 to 65, and a thickness of 0.05 to 2.5 mm, preferably 1.0 to 2.0 mm.

The golf ball according to the present invention should have a weight and diameter according to the Golf Rule. Usually, the weight is 45.93 g or less and the diameter is 42.67 mm or more.

EXAMPLE

The invention will be described in more detail with reference to the following examples and comparative examples, which are not intended to restrict the scope thereof.

Examples 1 and 2 and Comparative Example 1

Figure 6:
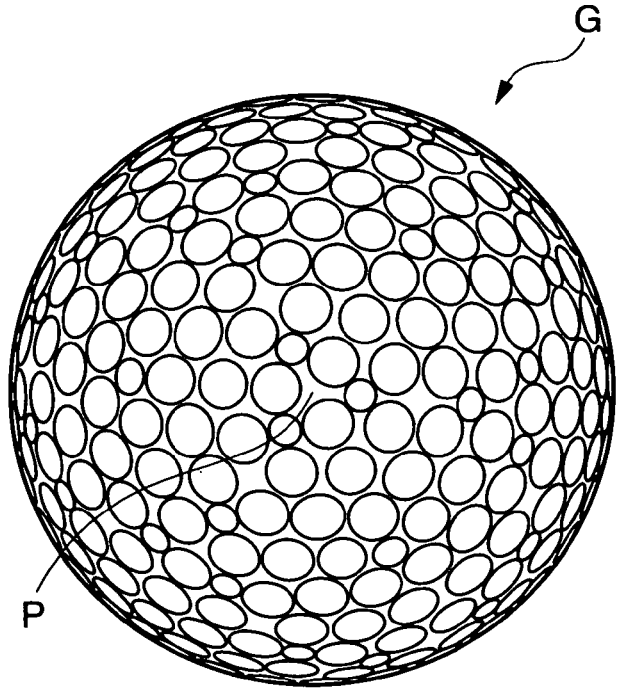
FIG. 6 is a plan view of the golf ball pertaining to a comparative example.

The golf balls according to Examples 1 and 2 have dimples arranged as shown in FIGS. 1 and 5, respectively. The golf ball according to Comparative Example 1 has dimples arranged as shown in FIG. 6. In all of these golf balls, dimples are arranged symmetrically with respect to the axis line (passing through both poles) at intervals of 120° around the axis line. Also, all of these golf balls have no great circle not intersecting dimples.

[Solid Core]

The golf balls according to Examples 1 and 2 and Comparative Example 1 have a solid core of single-layer structure made of polybutadiene rubber. The core has rigidity such that its deflection by compression on a hard board changes 2.98 mm when the compressing load is increased from 10 kg to 130 kg. Also, the core has a JIS-C hardness of 63.6 and 84.8 at its center and its surface, respectively.

[Cover]

The golf balls according to Examples 1 and 2 and Comparative Example 1 have a cover, 1.0 mm thick, which is made of thermoplastic polyurethane elastomer. The cover has a Shore D hardness of 50.

[Intermediate Layer]

The golf balls according to Examples 1 and 2 and Comparative Example 1 have an intermediate layer of ionomer resin, which is interposed between the core and the cover. The intermediate layer is 1.7 mm thick and has a Shore D hardness of 64.

The arrangement and specification of dimples on the golf balls are shown in Table 2.

TABLE 2

| | | Type | Diameter Dm (mm) | Depth Dp (mm) | Number | Total number | Ratio of maximum diameter to minimum diameter | Radius of curvature at central region R (mm) |
|---|---|---|---|---|---|---|---|---|
| Example | 1 | 1 | 4.85 | 0.11 | 186 | 276 | 1.63 | 210 |
| | | 2 | 4.4 | 0.11 | 66 | | | |
| | | 3 | 3.9 | 0.11 | 6 | | | |
| | | 4 | 3.4 | 0.11 | 6 | | | |
| | | 5 | 2.98 | 0.10 | 12 | | | |
| | | 6 | — | — | — | | | |
| | 2 | 1 | 5.5 | 0.105 | 18 | 270 | 1.62 | Infinity (flat) |
| | | 2 | 5.1 | 0.105 | 12 | | | |
| | | 3 | 4.9 | 0.100 | 174 | | | |
| | | 4 | 4.2 | 0.100 | 24 | | | |
| | | 5 | 3.8 | 0.100 | 6 | | | |
| | | 6 | 3.4 | 0.090 | 36 | | | |
| Comparative Example | 1 | 1 | 3.9 | 0.15 | 288 | 432 | 1.63 | 12 |
| | | 2 | 3.8 | 0.15 | 60 | | | |
| | | 3 | 3.4 | 0.15 | 12 | | | |
| | | 4 | 2.95 | 0.12 | 12 | | | |
| | | 5 | 2.4 | 0.09 | 60 | | | |
| | | 6 | — | — | — | | | |

TABLE 3

| | | Percentage of dimples larger than 4.7 mm in diameter (%) | Vo | SR (%) | VR (%) |
|---|---|---|---|---|---|
| Example | 1 | 67 | 0.65 | 81.2 | 0.814 |
| | 2 | 76 | 0.70 | 81.7 | 0.804 |
| Comparative Example | 1 | 0 | 0.47 | 80.0 | 0.77 |

Remarks:
Vo: The value obtained by dividing the volume under a flat surface surrounded by the edge of each dimple by the volume of a hypothetical cylinder having said flat surface as the bottom and the maximum depth from the bottom as the height.
SR: The ratio of the total flat area of dimples surrounded by the edges of dimples to the surface area of the ball which is calculated assuming that there are no dimples.
VR: The ratio of the total volume of dimples under flat surface surrounded by the edges of dimples to the volume of the ball which is calculated assuming that there are no dimples.

The golf balls according to Examples 1 and 2 and Comparative Example 1 were tested for flight performance. The results are shown in Table 4. Flight performance was evaluated by measuring the flying distance which was attained when the sample ball was hit at a head speed of 45 m/s by a driver (W #1) fixed to a hitting machine.

TABLE 4

| | | Ratio of CL at | Value of CD at | Distance (m) | |
|---|---|---|---|---|---|
| | | low velocity | high velocity | Carry | Total |
| Example | 1 (FIG. 1) | 83 | 0.219 | 223 | 244 |
| | 2 (FIG. 5) | 81 | 0.215 | 225 | 245 |
| Comparative Example | 1 (FIG. 6) | 65 | 0.215 | 220 | 242 |

Remarks
The ratio of CL at low speed was calculated by diving CL at a Reynolds number of 70000 and a spin of 2000 rpm. The initial velocity at the time of hitting was adjusted to 65 m/s by using a hitting robot. The value of CD at high velocity was obtained by measuring the coefficient of drag at a Reynolds number of 180000 and a spin of 2520 rpm immediately after hitting.

The invention claimed is:

1. A golf ball having a plurality of round dimples on the surface thereof, which is characterized in that said dimples include those of two kinds or more differing in diameter such that the ratio of the maximum diameter to the minimum diameter is at least 1.5, said dimples add up to 240 to 290, with large dimples 4.7 mm or above in diameter accounting for more than 50%, and said dimples are formed such that the volume under a flat surface surrounded by the edge of each dimple divided by the volume of a hypothetical cylinder having said flat surface as the bottom and the maximum depth from the bottom as the height is 0.49 to 0.85 on average for all the dimples.

2. The golf ball of claim 1, wherein the dimples account for 79% to 89% of the entire surface area of the golf ball, and the dimples are arranged such that there exist no or only one great circle not intersecting the dimples on the surface of the golf ball.

3. The golf ball of claim 1, which include those dimples formed such that the dimple's central region within half the radius from the dimple's center has a cross section coinciding with the radius of curvature larger than 20 mm, with its center placed outside in the radial direction of the golf ball.

4. The golf ball of in claim 1, wherein the dimples have a cross section such that the straight line connecting both edges of the cross section and the side wall leading to the edge of the cross section make an angle of 10° to 25°.

5. The golf ball of claim 1, wherein the dimples are formed such that the ratio VR of the total volume of dimples under flat surface surrounded by the edges of dimples is 0.6% to 1.1% to the volume of the ball which is calculated assuming that there are no dimples.

6. The golf ball of claim 1, which has aerodynamic properties such that the coefficient of lift (CL) of the hit ball with a Reynolds number of 70000 and a spin of 2000 rpm is higher than 70% of that of the hit ball with a Reynolds number of 80000 and a spin of 2000 rpm, and the coefficient of drag (CD) of the hit ball with a Reynolds number of 180000 and a spin of 2520 rpm is lower than 0.225.

* * * * *